United States Patent [19]

Fandrich et al.

[11] Patent Number: 4,953,433

[45] Date of Patent: Sep. 4, 1990

[54] ACTION FOR GRAND PIANO

[76] Inventors: Darrell G. Fandrich, 210 Third Ave., S., Seattle, Wash. 98104; Chris A. Trevelas, 222 NW. 49th, Seattle, Wash. 98107

[21] Appl. No.: 421,374

[22] Filed: Oct. 16, 1989

[51] Int. Cl.[5] ..... G10C 3/18

[52] U.S. Cl. ..... 84/239; 84/243

[58] Field of Search ..... 84/239, 243, 240, 241, 84/247, 236, 237, 253, 242

[56] References Cited

U.S. PATENT DOCUMENTS

| | | | |
|---|---|---|---|
| 143,986 | 10/1973 | Koth | 84/237 |
| 210,223 | 11/1978 | Plass | 84/237 |
| 229,066 | 6/1880 | Westermayer | 84/236 |
| 294,004 | 2/1984 | Biese et al. | 84/237 |
| 666,138 | 1/1901 | Hallé | 84/238 |
| 952,417 | 3/1910 | Clark | 84/237 |
| 1,000,762 | 8/1911 | Soper | 84/241 |
| 1,353,647 | 9/1920 | George | 84/237 |
| 1,490,229 | 4/1924 | Perry | 84/237 |
| 2,442,182 | 5/1948 | Socin | 84/239 |
| 4,896,577 | 1/1990 | Trivelas et al. | 84/240 |

FOREIGN PATENT DOCUMENTS

| | | | |
|---|---|---|---|
| 35508 | 8/1885 | Fed. Rep. of Germany | 84/243 |

*Primary Examiner*—Brian W. Brown

*Attorney, Agent, or Firm*—Robert W. Jenny

[57] ABSTRACT

The subject grand piano action, in common with all piano actions, comprises driving apparatus comprising the key and wippen levers, drive apparatus comprising the hammer assembly and apparatus interconnecting the two and providing for disengagement and reengagement of the driven with the driving apparatus. In the subject action the interconnecting apparatus comprises the jack, pivoted to the free end of the wippen lever and a repetition spring pivoted at both ends, one end at the free end of the jack, the other on the hammer shank. When the key is played and the free end of the wippen lever rises, a cam on the side of the jack facing away from the wippen lever engages a button mounted on the hammer rail and this engagement forces the end of the jack along a hard felt cam on the hammer knuckle. The cams on the jack and hammer knuckle are contoured such that the jack end and the jack actuation button remain in contact or close proximity to their respective cams throughout engagement and dis-engagement of the jack. There are two mechanical adjustments and one spring adjustment in the action. This configuration enables a simpler, quieter, easier to adjust action which stays in adjustment for longer periods of playing time and with no sacrifice in performance.

2 Claims, 4 Drawing Sheets

ACTION FOR GRAND PIANO

BACKGROUND OF THE INVENTION

1. Field:

The invention is in the field of musical instruments, specifically pianos and, more specifically, grand pianos. Still more specifically it is in the field of actions for grand pianos, the mechanisms through which a string is struck when a key is depressed.

2. Prior Art:

There is profuse prior art in the specific field of actions for grand pianos. The patents listed below, a sampling of the art, include patents selected as particularly relevant to the subject action.

| | |
|---|---|
| 143,986 | 952,417 |
| 210,223 | 1,353,647 |
| 229,066 | 1,000,672 |
| 294,004 | 1,490,229 |

A U.S. patent application Ser. No. 104,277, filed 10/02/87, U.S. Pat. No. 4,89 by the subject inventors is also pertinent prior art. However, the most pertinent prior art is the Herz-Erard action which has been in most common use for many years. This action has been and is considered entirely adequate and there has been no well known call or suggestion for improvements in it or for an improved one to supercede it. Nevertheless, certain characteristics of the Herz-Erard action are recognized by those skilled in the art as providing a basis for seeking improvements in the action for grand pianos. The Herz-Erard action is acknowledged to be complex, resulting in considerable cost to manufacture it and in its being relatively difficult and sensitive to adjust. The complexity contributes to its fragility. Further, partly because of the complexity and partly because of the need to use soft cushions in the action, the action must be adjusted frequently to maintain top performance and avoid unwanted noises.

Therefore the prime objective of the subject invention is to provide an action for grand pianos which is improved over the Herz-Erard action with no sacrifice in performance. Further objectives are that the improvements include less complexity, with related lower cost of the action and simplification of adjustment, greater durability, allowance of less frequent adjustment to maintain top performance, and reduction of noises in the action. These mechanical noises are irritating to pianists and a particular problem when the grand piano is being recorded by sensitive high fidelity equipment.

SUMMARY OF THE INVENTION

The subject invention is described with reference to the fact that piano actions comprise driving apparatus, driven apparatus and apparatus interconnecting the two. The driving apparatus comprises the key and the wippen levers, although in primitive actions the wippen is not always used. The driven apparatus is the hammer assembly. The interconnecting apparatus of the subject action comprises the jack and the repetition spring, whereas in the Herz-Erard action it comprises the jack, the repetition lever (since it helps support the hammer) and the repetition spring. In all cases there is some occasional interconnection of the driving and driven apparatuses by the back catch apparatus.

A first feature essential to the function of a piano action is that the capability of the driving apparatus to drive the driven apparatus must be definitely and precisely interrupted at a certain point before the hammer strikes the string(s). This is necessary to allow the hammer to rebound and not be held against the string(s). The second essential feature is that the capability for the driving apparatus to drive the driven apparatus must be restored as quickly and positively as can be achieved when the effort applied to the key by the player relaxes.

Optimum achievement of the functional features requires that the separation of the jack from the hammer assembly be kept as small as possible at all times in terms of both distance and time.

If there is any separation between the driving and driven apparatus during play, such as a separation between the end of the jack and the hammer butt, there is key motion which produces no hammer motion. This motion is termed lost. If the gap is present under static conditions the lost motion is termed static lost motion. If the gap is present and caused by the dynamics of the action, the lost motion is termed dynamic lost motion. The closure of the gap involved in lost motion cause mechanical noise and undue impact wear on the parts involved, degrading the performance of the action. Keeping lost motion to a minimum is essential to meeting the objectives of the subject invention and it is considered that it will be understood from the descriptions herein of the subject invention that lost motion is kept to a minimum in the subject action.

The subject invention lies primarily in the interconnection apparatus, i.e. the jack and repetition spring, these being essential to the functional features described.

In a preferred embodiment of the subject action the jack is pivoted at the free end of the wippen lever and, in the at rest condition of the action, the jack is slightly off vertical toward the pivoted end of the wippen lever. The free end of the jack contacts a cam shaped pad, i.e. knuckle, on the lower side of the hammer shank about one-sixth of the distance from the hammer pivot to the hammer head. A cam is attached to the jack on its side that faces away from the wippen lever pivot end and at a point approximately a fourth of the distance from the jack pivot point to the jack end. A button, termed the jack actuation button is adjustably attached to the hammer rail and positioned such that when the key is played and the free end of the wippen lever rises, carrying the jack with it, the jack cam contacts the actuation button, causing the free end of the jack to move away from the pivoted end of the hammer assembly, thus disconnecting the driving and driven apparatuses, i.e. disengaging. This disengaging motion of the jack is resisted by a pin ended, safety pin type compression spring. One end of the spring is pivoted at at point close to the end of the jack. The other end is pivoted on the hammer shank at a point approximately twice the distance between the jack end and the hammer pivot in the at-rest condition of this action. As the jack pivots during the playing of a note the spring is compressed and its line of action is altered such that its effective lever arm about the hammer pivot increases. At full disengagement the torque produced by the fully compressed spring at its maximum lever arm alignment is sufficient to support the weight of the hammer assembly. In the preferred embodiment of the action the free length of the spring (pin to pin) is approximately 1⅛ inches, the installed length is approximately 1-1/16 inches and the maximum compressed length is approximately ¾ inches. Thus preload in the at-rest condition is a small fraction of the maximum load.

During the playing of a note and before disengagement the realignment of the line of action of the repetition spring reduces its lever arm about the hammer assembly pivot minimally.

With release of the key, the backcheck releases its hold on the hammer and the repetition spring exerts a lifting force on the hammer as the jack end moves under the hammer knuckle. As the jack continues to move the compression of the spring and its leverage over the hammer assembly rapidly decrease, allowing it to settle onto the jack end. However, the force of spring, abetted by the mechanical advantage provided to the jack by the cam shape of the knuckle, easily completes reengagement of the jack.

The jack end can be as wide as spacing between notes will allow, which is much wider than is possible with the Herz-Erard action and thus affords a low pressure contact relative to the force levels involved. The low contact pressure makes for durability and for long duration of the effects of adjustments.

In comparison, the width of the jack of the Herz-Erard action is limited because the available space on the knuckle must be shared with the repetition lever, resulting in high pressure contact between the jack and knuckle. The repetition spring in the Herz-Erard action deflects very little during disengagement and reengagement, and its line of action and related effective lever arms also change very little. As a result, during reengagement there is not enough energy available for reengagement to occur without the help of the mechanical interaction involving the repetition lever whereby clearance for jack reengagement is provided mechanically and constitutes lost motion. This means that when a note is played there is always some clearance to be taken up and adjustments are highly critical. Also, there are five mechanical adjustments and a spring adjustment compared to the two mechanical adjustments and a spring adjustment in the subject action.

The invention is described in more detail below with reference to the attached drawings.

DETAILED DESCRIPTION OF THE INVENTION

The subject invention is an action for grand pianos and any keyboard instrument in which struck strings are replaced by electric/ electronic apparatus and the classic feel of the grand piano action is to be retained. For purposes of this description it is assumed that persons of ordinary skill in the art are familiar with the prior art Herz-Erard action and have good working knowledge of it including its function and the nomenclature of its components. Also, the parts common to the subject action and the Herz-Erard action to which it is compared in the description are essentially identical.

Figure 1:
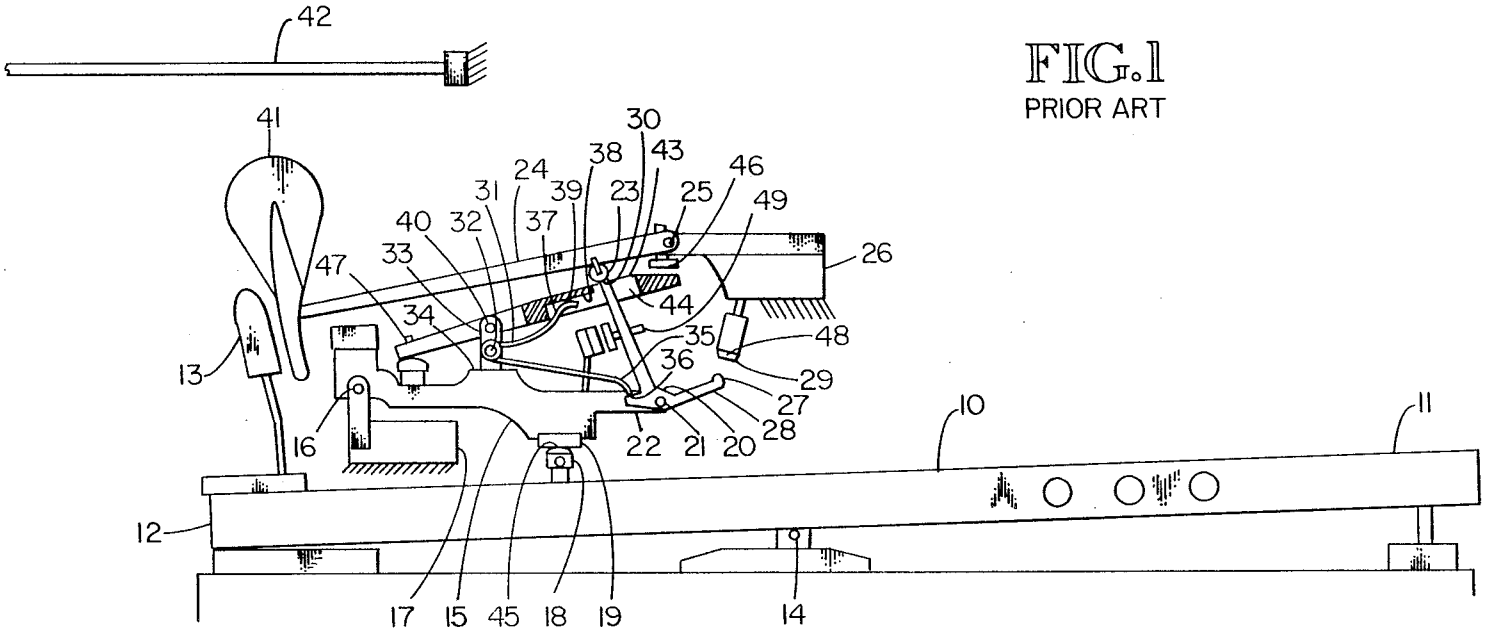
FIG. 1 PRIOR ART
FIG. 1 is a partially sectioned schematic drawing of the prior art Herz-Erard action in the at-rest condition.

FIG. 1 is a partially sectioned schematic drawing of the Herz-Erard action in the at-rest condition. Key 10 has a playing end 11 having key weights, weight 11' being typical, and a working end 12 which supports backcheck 13 and is supported at fulcrum 14 attached to the fixed structure of the piano as denoted by the open end cross-hatching. Wippen lever is 15 is pivoted at 16 to structural assembly 17 which is attached to the fixed structure. Adjustable capstan 18, termed a wippen fulcrum, screwed into the working end of the key, contacts wippen butt 19 on the wippen lever and raises the lever when the playing end of the key is depressed. Jack 20 is pivoted at 21 to the free end 22 of the wippen lever. When the key is played and the wippen is raised, the jack, in contact with hammer knuckle 23, pivots hammer assembly 24 about hammer pivot 25 on hammer rail 26 attached to fixed structure and end 27 of arm 28 of the jack contacts adjustable button 29 and further motion of the wippen causes end 30 of the jack to move out of contact with the hammer knuckle 23, i.e. disengage. Safety pin type spring 31 is retained by pin 32 in post 33 which extends from top 34 of the wippen lever. Leg 35 of the spring contacts short arm 36 on the jack and provides a force at a lever arm from pivot 21 to produce a torque which tends to re-engage the jack with the hammer knuckle. Leg 37 of the spring contacts the repetition lever 38 at point 39 at a lever arm distance from pivot 40 by which the repetition lever is pivoted to post 33. The force applied by leg 37 at the lever arm distance acts, as described below, to move the hammer 41 toward string 42. The jack operates in slot 43 in the repetition lever, side structure 44 of the slot being visible in this sectional view of the repetition lever. For this action to function adequately adjustments must be made at points 45, 46, 47, 48 and 49.

The force applied by spring leg 37 at the lever arm distance provides a torque which holds the repetition lever against the wippen lever at adjustment point 47. The upper surface of the repetition lever at its point of contact with the knuckle is adjusted by adjustment 47 to rest slightly above the end 30 of the jack. The slight difference in height between the top of the jack and the top of the repetition lever at their points of contact with the knuckle provides a small gap which enables the jack to freely re-engage and inevitably introduces lost motion into the action.

When a note has been played and the key is held in a depressed position, the hammer rebounds from the string and is caught by the backcheck 13. In this position the jack is disenegaged and the knuckle 23 has depressed the repetition lever and compressed the repetition spring 31. At this point if the playing end of the key 11 is allowed to rise slightly, the backcheck releases its grip on the hammer and the repetition spring, if properly adjusted, will act through the repetition lever to swiftly raise the hammer toward the string. This movement is stopped at a point when the hammer is about ⅛ inch from the string by contact of the repetition lever with the drop screw adjustment 46. When the jack is disengaged, the jack center 21 is closer to the knuckle 23 than at any other time. The repetition lever 38, the repetition spring 31, the adjustment screw 47 and the drop screw 46 are all provided to swiftly separate the jack center from the knuckle and to cease this separation as soon as the jack is able to re-engage.

Figure 2:
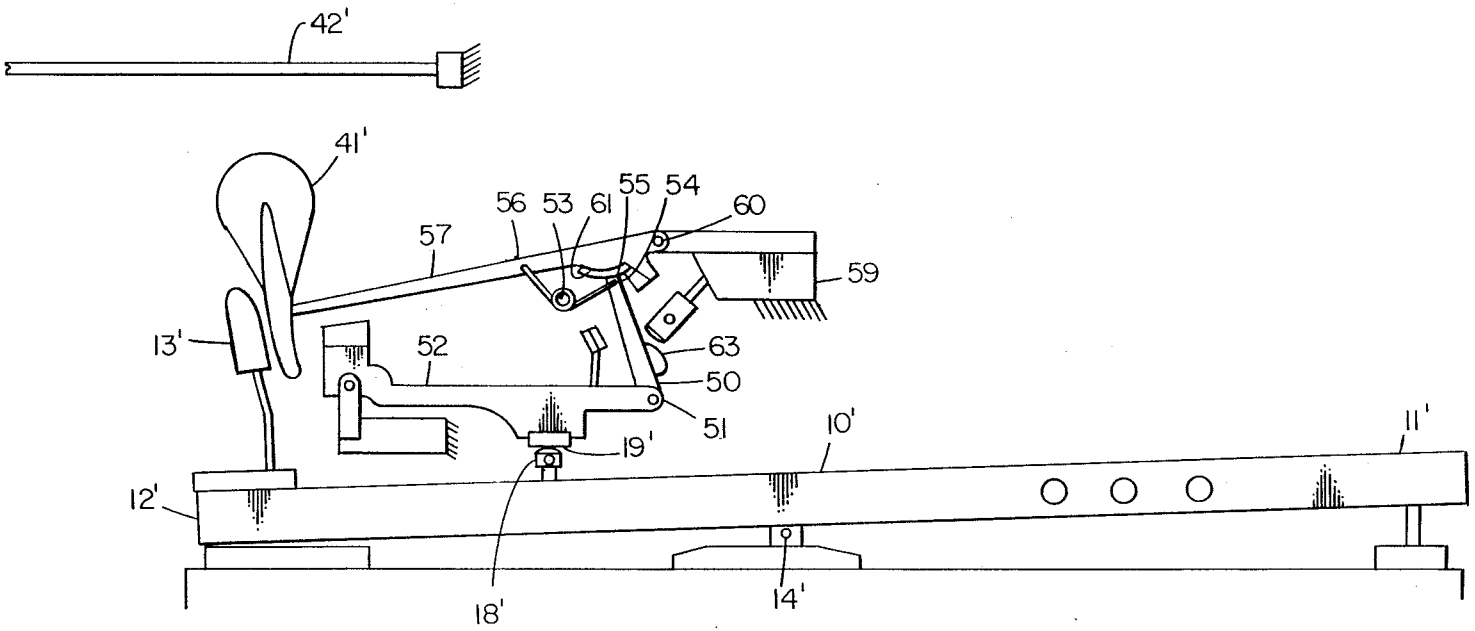
FIG. 2 is a schematic drawing of the subject action in the at-rest condition.

FIG. 2 is a schematic drawing of the subject action in the at-rest condition. The action is essentially identical to the Herz-Erard action as described except for the apparatus which interconnects the driving apparatus (key and wippen lever) and the driven apparatus (hammer assembly).

Figure 3:
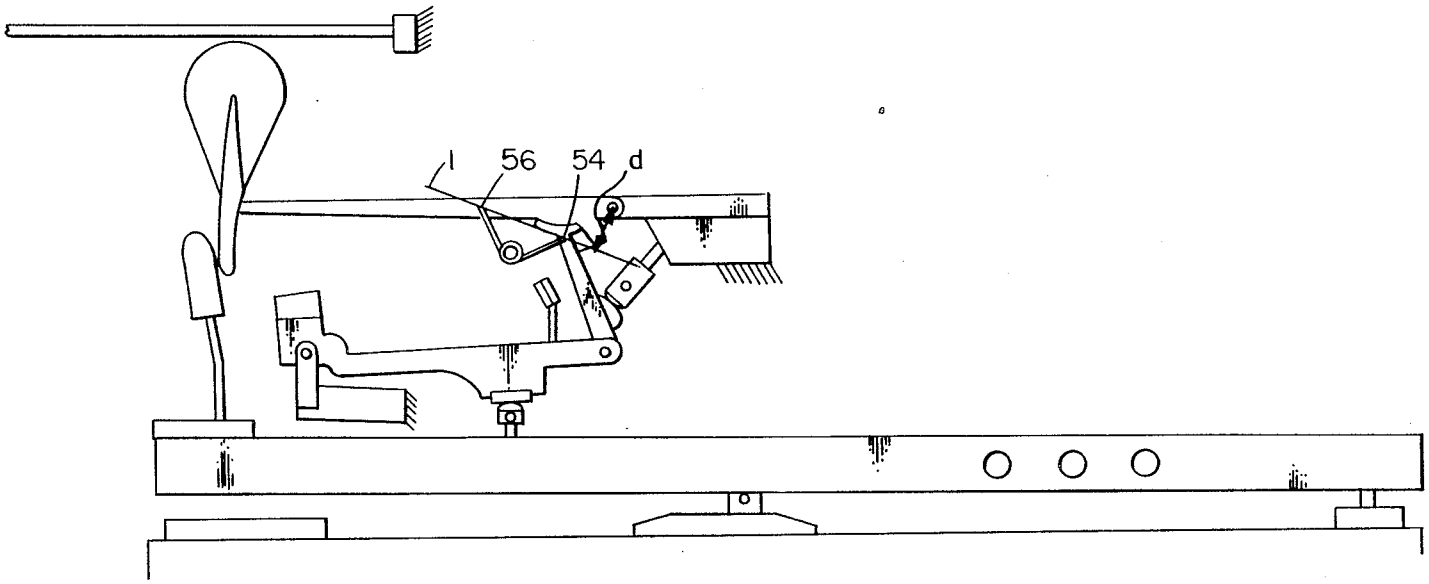
FIG. 3 is a schematic drawing of the subject action in which the playing end of the key has been depressed slowly to bring the action to the point of initiation of disengagement.
Figure 4:
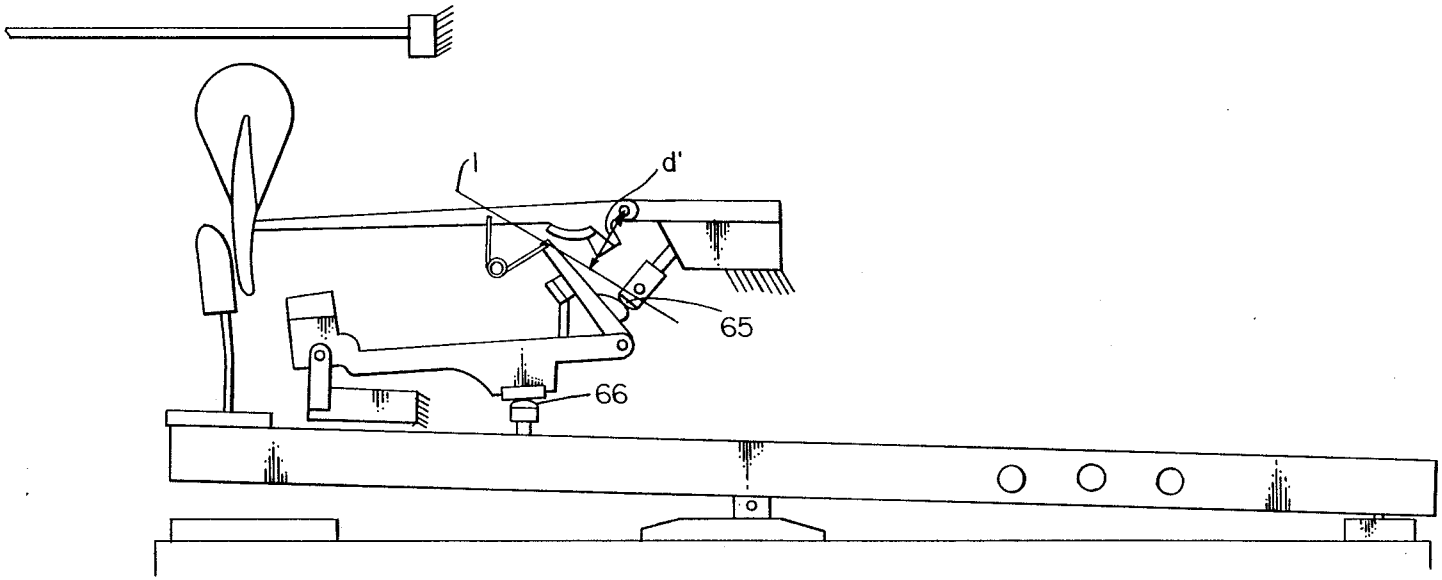
FIG. 4 is a schematic drawing of the subject action with the playing end of the key fully depressed and the action fully disengaged.

Parts shown in FIGS. 2, 3 and 4, essentially identical to those in FIG. 1 and not otherwise numbered, are like numbered but primed. In the subject action key 10' has a playing end 11' and a working end 12'. The key is supported on fulcrum 14'. Capstan 18' contacts wippen butt 19'. In this action and the prior art actions the keys, wippen levers and hammer shanks have long dimensions and the parts are positioned with the long dimensions all essentially horizontal.

In this action the interconnecting apparatus comprises the jack 50 pivoted to the free end 51 of wippen lever 52 and repetition spring 53 pivoted at one end at point 54 close to free end 55 of the jack and at its other end at point 56 on hammer shank 57 of hammer assembly 58 pivoted to hammer rail 59 by hammer assembly pivot 60. The hammer rail is attached to fixed structure. Free end 55 of the jack contacts hammer knuckle 61 which is cam shaped such that during the entire function of the action end 55 is either in contact with or in close proximity to surface 62 of pad 61. When the key is played and the free end of the wippen lever is raised cam 63 on the jack contacts jack actuating button 64 which is adjustably mounted on the hammer rail, as shown in FIG. 3. One example of such camming operation of the jack is shown in prior art patent 229,066. With the action as shown in FIG. 3 the line of the action 1 of the repetition spring is such that the effective lever arm of the spring is d. Fully and slowly depressing the playing end of the key brings the action to the condition shown in FIG. 4 in which the jack has been cammed into full disengagement. At this point the repetition spring is fully compressed and its line of action 1 is now such that its effective lever arm about pivot 60 is d' and d' is approximately 55% greater than d. The spring is adjusted so that the force applied by the fully compressed spring acting with lever arm d' is sufficient to just support the hammer assembly against the force of gravity. Examples of a repetition spring of the type in this action are shown in patent no. 1,000,762 and in U.S. patent application Ser. No. 104,277, filed 10/02/87, by the subject inventors. In the subject action the spring has a free length of about 1-⅛ inches, an installed length of about 1-1/16 inches and a maximum compression length of about ¾ of an inch. It is essentially symmetrical about the loop, the arm lengths are about ¾ of an inch long and the angle between them varies in the range of 85° to 125°.

It is noteworthy that in the subject action there are mechanical adjustments at points 65 and 66 only. It is also noteworthy that the shape of the cam surface on the hammer knuckle is such that after the key has been fully depressed the key can be let up and the jack will move from its fully disengaged position to its fully engaged position while maintaining the end of the jack and the hammer knuckle cam in constant contact. This situation makes restrike possible when the playing end of the key is no more than one-third returned to the at-rest position. Also the limitation of clearance between the hammer knuckle cam and the jack end eliminates all lost motion and allows for use of harder pads without causing unacceptable mechanical noise. Further, the end of the jack can be as wide as space for the action allows so that the area of contact between the jack end and hammer butt cam can be relatively large and contact pressure correspondingly low. The harder pads and lower contact pressure (force per unit of contact area) significantly reduce wear and compression set of the pads, extending the playing time between adjust- ment. The reduced lost motion has the same effects.

It is believed to be understandable from this description that the subject invention meets its objectives. It is less complex than the Herz-Erard action. It is simpler to adjust, having only two mechanical adjustments and one spring adjustment. Once adjusted it will stay adjusted for longer periods of playing time because of the harder pads and lower unit pressure on the jack end. The harder pads in combination with inherently limited clearance between parts during engagement and disengagement make for considerably less mechanical noise in the action.

It is also considered to be understandable from this description that while one embodiment of the subject invention is described herein, other embodiments and modifications of the one described are possible within the scope of the invention which is limited only by the attached claims.

We claim:

1. In combination, a grand piano and an action for said grand piano, said grand piano having a basic structure, said basic structure comprising a hammer rail, said action comprising:

a driving apparatus, a driven apparatus, interconnection apparatus and a jack actuating button attached to said hammer rail, said action having an at-rest condition, said driving apparatus comprising:

a key having a playing end and a working end and being supported on a key fulcrum between said playing and working ends, said key fulcrum being attached to said basic structure, whereby said action is activated by application of force to said played end of said key by a player, said action further comprising:

a wippen lever having a pivoted end and a free end, said pivoted end being pivoted to said fixed structure, said wippen lever further comprising a wippen butt positioned between said pivoted and free ends of said wippen lever, said key further comprising an upper surface and a wippen fulcrum attached to said upper surface and positioned to contact said wippen butt whereby said wippen is supported by said wippen fulcrum, said driven apparatus comprising:

a hammer assembly, said hammer assembly further comprising:

a shank having a pivoted end, a head and a hammer butt attached to said shank and having a cam surface, a hammer assembly pivot, said pivoted end of said shank being pivoted to said hammer rail by said hammer assembly pivot, said key, wippen lever and shank having long dimensions, said key, wippen lever and shank being positioned with said long dimensions essentially horizontal such that the forces of gravity on said key, wippen lever and hammer assembly tend to return said action to said at-rest condition.

said interconnecting apparatus comprising in combination:

a jack having a pivoted end and a free end, a cam side and a jack cam on said cam side between said pivoted end and said free end of said jack, said pivoted end of said jack being pivoted to said free end of said wippen lever and extending generally upward with said free end of said jack contacting, in said at-rest condition, said cam surface on said hammer butt to support said hammer assembly, said jack cam having a surface and being positioned such that said surface of said jack cam contacts said jack actuating button and a safety pin type compression spring having first and second ends, said first end being pivoted on said shank of said hammer assembly, said second end being pivoted on said free end of said jack, said spring having a line of action at a variable lever arm distance from said hammer assembly pivot and applying a force to said free end of said jack and an equal and opposite force to said hammer shank, whereby when said player applies said force to said playing end of said key and said playing end of said key is depressed, said action moves out of said at-rest condition and said key rocks on said fulcrum to raise said wippen fulcrum which raises said wippen lever, lifting said jack whereby said jack cam cooperates with said jack actuating button and said jack is pivoted toward said pivoted end of said wippen lever and said free end of said jack moves along said cam surface on said hammer butt, said jack cam and said cam surface on said hammer butt being contoured such that as said jack cam moves past said jack actuating button and said free end of said jack moves along said cam surface of said hammer butt, said jack cam stays in contact with said jack actuating button under said force applied by said repetition spring to said free end of said jack and said free end breaks contact with said cam surface on said hammer butt, remains in close proximity to said surface and said equal and opposite force applied by said repetition spring supports said hammer assembly, and further whereby when said force applied to said playing end of said key is reduced and said action begins to return to said at-rest condition due to the force of gravity on said apparatuses and to said forces applied by said repetition spring, said free end of said jack is in position to contact and support said hammer assembly if said force applied to said playing end is increased.

2. The action of claim 1 in which said variable lever arm distance increases as said playing end of said key is depressed and decreases when said action is returning to said at-rest condition when said force on said playing end of said key is reduced.

* * * * *